US006169497B1

(12) United States Patent
Robert

(10) Patent No.: US 6,169,497 B1
(45) Date of Patent: Jan. 2, 2001

(54) MOBILE TRACKING AND POSITIONING SYSTEM

(75) Inventor: Bruno Robert, Grand-Duchy (LU)

(73) Assignee: Bruno G. Robert, Brussels (BE)

( * ) Notice: Under 35 U.S.C. 154(b), the term of this patent shall be extended for 0 days.

(21) Appl. No.: 08/358,792

(22) Filed: Dec. 16, 1994

Related U.S. Application Data

(63) Continuation-in-part of application No. 08/041,690, filed on Apr. 1, 1993, now abandoned.

(51) Int. Cl.[7] ..... G08G 1/123
(52) U.S. Cl. ..... 340/988; 342/457; 701/300
(58) Field of Search ..... 340/988, 991, 340/426, 539, 993, 961; 342/450, 357, 457; 364/449; 701/213, 300

(56) References Cited

U.S. PATENT DOCUMENTS 3,828,306 * 8/1974 Angeloni ..... 342/457
3,984,807 * 10/1976 Haemmig ..... 340/991
4,177,466 12/1979 Reagan .
4,651,157 3/1987 Gray et al. .
4,742,357 5/1988 Rackley .
4,818,998 * 4/1989 Apsell et al. ..... 342/457
4,819,053 4/1989 Halavais .
5,003,317 * 3/1991 Gray et al. ..... 342/457
5,021,794 * 6/1991 Lawrence ..... 342/457
5,119,102 6/1992 Barnard .
5,153,836 * 10/1992 Fraughton et al. ..... 340/961
5,208,756 5/1993 Song .
5,311,197 * 5/1994 Sorden et al. ..... 342/457
5,345,245 9/1994 Ishikawa et al. .
5,418,537 * 5/1995 Bird ..... 342/457
5,430,656 * 7/1995 Dekel et al. ..... 342/457

* cited by examiner

*Primary Examiner*—Brent A. Swarthout
(74) *Attorney, Agent, or Firm*—McIntyre Hazrbin & King

(57) ABSTRACT

A mobile tracking and positioning system includes a plurality of mobile transmit and receive stations that track a mobile target which emits a radio signal in response to the occurrence of a tracking effort initiation event. The tracking stations have a GPS receiver or like means for determining their position, a radio direction finder responsive to the radio signal that determines the vector to the mobile target, a two-way communications system and a computer. The mobile transmit and receive stations exchange their position and direction to target information via the two-way communications systems, enabling the stations to triangulate the location of the target with their computers.

36 Claims, 6 Drawing Sheets

MOBILE TRACKING AND POSITIONING SYSTEM

This is a continuation-in-part application of Ser. No. 08/041,690, filed Apr. 1, 1993, now abandoned.

BACKGROUND OF THE INVENTION

A. Field of the Invention

The present invention relates generally to the field of systems for tracking and positioning an entity or target, such as a vehicle or person, by surveillance or tracking persons or stations. More particularly, this invention relates to a mobile tracking and positioning system in which a mobile target is tracked by two or more mobile tracking and positioning stations continuously as all the elements of the system (i.e., the target and the tracking and positioning stations) move about or over the surface of the earth. Some typical applications of the invention are in the private security and transportation industries, where the location of a person or vehicle (or persons and fleets of vehicles) are monitored; the recovery of stolen vehicles; and in government applications such as surveillance, intelligence or counterterrorism, where a person or vehicle is positioned and tracked by police or military units.

B. Description of Related Art

Prior art tracking and positioning systems fall into three general categories: homing systems with one or several homing vehicles, triangulation systems using two fixed points to locate the target, and triangulation systems using one or more fixed points together with a homing vehicle. Each has its own limitations and drawbacks.

Homing systems with mobile vehicles typically use arrows in the vehicle cockpit with a direction finding apparatus. Some detector of proximity to the target is also involved. These systems have no real precision location or mapping capabilities. The present invention provides real-time precision mapping and locating of the target by mobile tracking stations.

Stationary triangulation systems are inherently inflexible, as the position of the triangulation stations is fixed. Ideally, the tracking units should have the flexibility to move about in the surveillance and tracking effort. The present invention provides this capability.

Triangulation systems using a fixed point and a mobile homing vehicle are always obliged to use one fixed antenna. The precision in locating the target is not as good, as the homing vehicle does not know its correct position. Since the calculation of the target location is made at the fixed antenna site, the use of direction finding equipment linked to proximity detectors is necessary at the homing vehicle.

U.S. Pat. No. 5,345,245 to Ishikawa et al. describes a differential ranging system in which a fixed reference with a known position transmits a corrective factor to a mobile station. The system depends upon a fixed station, hence lacks flexibility and true mobility of all parts of the system. Similarly, U.S. Pat. No. 5,111,209 to Toriyama relates to a satellite-based position determination system that is dependent upon fixed stations. The present invention overcomes these drawbacks by providing true mobile tracking capabilities, without the dependency on a fixed antenna or proximity detectors to locate the target, and wherein each of the mobile tracking stations can precisely locate and map the position of the target. As used herein, the term "mobile", when referring to a tracking and positioning station, refers to a station that has the ability to physically move from one place to another, whether the communication and positioning equipment that constitutes a "station" is installed in a car, an aircraft, a boat, or even carried by a person.

SUMMARY OF THE INVENTION

In one principal aspect of the invention, a mobile tracking and positioning system is provided which comprises a mobile receive station, a mobile transmit and receive station, and a mobile target to be tracked and located by the mobile receive station and the mobile transmit and receive station. The mobile target includes a means for selectively broadcasting a communication signal in response to a tracking and positioning initiation event. In the case where the target is a vehicle, the initiation event could be the unauthorized movement (e.g., theft) of the vehicle, the manual operation of a switch or button, such as an ON-OFF switch associated with the transmission unit of the target, or the transmission of an activation or initiation signal from a portable remote control unit to the target to initiate broadcasting of the communication signal. An example of the communication signal broadcast by the target is a radio signal having a certain frequency or pattern.

The mobile transmit and receive station has a positioning means for substantially continuously determining the position of the mobile transmit and receive station, for example, a global positioning system (GPS) receiver, or a receiver operating under GLONASS (Global Orbiting Navigation Satellite System). The station further includes a direction means for receiving the communication signal broadcast from the target and for responsively determining the direction from the mobile transmit and receive station to the target. Where the communication signal is a radio signal, an example of the direction means would be a radio direction finder (RDF). The station further includes a communications system for transmitting information of the station's position and the direction to the target to the mobile receive station.

The mobile receive station also has a positioning means for determining the position of the mobile receive station (such as, for example, a GPS receiver), a direction means for receiving the communication signal broadcast from the target and for responsively determining the direction from the mobile receive station to the mobile target (such as an RDF), and a communications system for receiving the transmitted information of the position of the mobile transmit and receive station and the direction of the target to the mobile transmit and receive station. The mobile receive station further includes a computer that triangulates the position of the target from the known position of the mobile transmit and receive station, the known position of the mobile receive station, the known direction of the mobile transmit and receive station to the target, and the known direction of the mobile receive station to the target. By virtue of substantially continuous passing of position and direction information from the mobile transmit and receive station to the mobile receive station, and the simultaneous determination of position and direction information at the mobile receive station, the computer can substantially continuously update the position of the target as the target, the mobile transmit and receive station, and the mobile receive station all move about or above the surface of the earth.

The mobile receive station may be provided with the capability of also transmitting its position and direction information to the mobile transmit and receive station, and the mobile transmit and receive station may be provided with a computer to process the position and direction information of both stations to determine the location of the target. This aspect of the invention results in both stations having equal capability to track and locate the target.

In another aspect of the invention, the tracking and positioning system consists of a plurality of mobile transmit and receive stations, each with the capability of (1) transmitting its position and direction information to the other stations, (2) receiving transmissions of position and direction information from the other stations, and (3) processing via a computer the received position and direction information and the station's own position and direction information to determine the location of the target.

In yet another aspect of the invention, the activation of the target to begin transmission of the communication signal may involve the transmission of identification codes to the target. The identification codes are associated with the particular mobile transmit and receive stations that are to participate in the tracking and positioning effort, and with the particular target to be tracked. This option may be utilized where a large number of targets, only one of which is to be tracked, are present in the field, and where there are a large number of mobile transmit and receive stations in the field, and only certain stations are to participate in the tracking and positioning effort. The remaining targets, and the nonparticipatory mobile transmit and receive stations, are in a power-down (i.e., dormant) mode and only become activated when the need arises. Alternatively, multiple targets may be tracked by the transmit and receive stations simultaneously because the targets have their own id codes.

The present invention is a truly mobile, independent tracking system. The essential units of the system can be carried to specific locations or regions and implemented, indeed the invention could be implemented virtually anywhere in the world since it relies on its own radio and communication systems. The invention is also self-reliant. Additionally, the communication transmission unit located at the target is readily miniaturized, much more so than many other types of tracking systems, since the transmission unit is not acquiring GPS or other satellite data but is rather functioning as a radiotransmitter.

These and still other features and aspects of the invention will become apparent from the following detailed description of preferred and alternative embodiments of the invention.

BRIEF DESCRIPTION OF THE DRAWINGS

Presently preferred and alternative embodiments of the invention are depicted in the appended drawings, wherein like reference numeral refer to like elements in the various figures, and wherein.

DETAILED DESCRIPTION OF THE PREFERRED AND ALTERNATIVE EMBODIMENTS OF THE INVENTION

Figure 1:
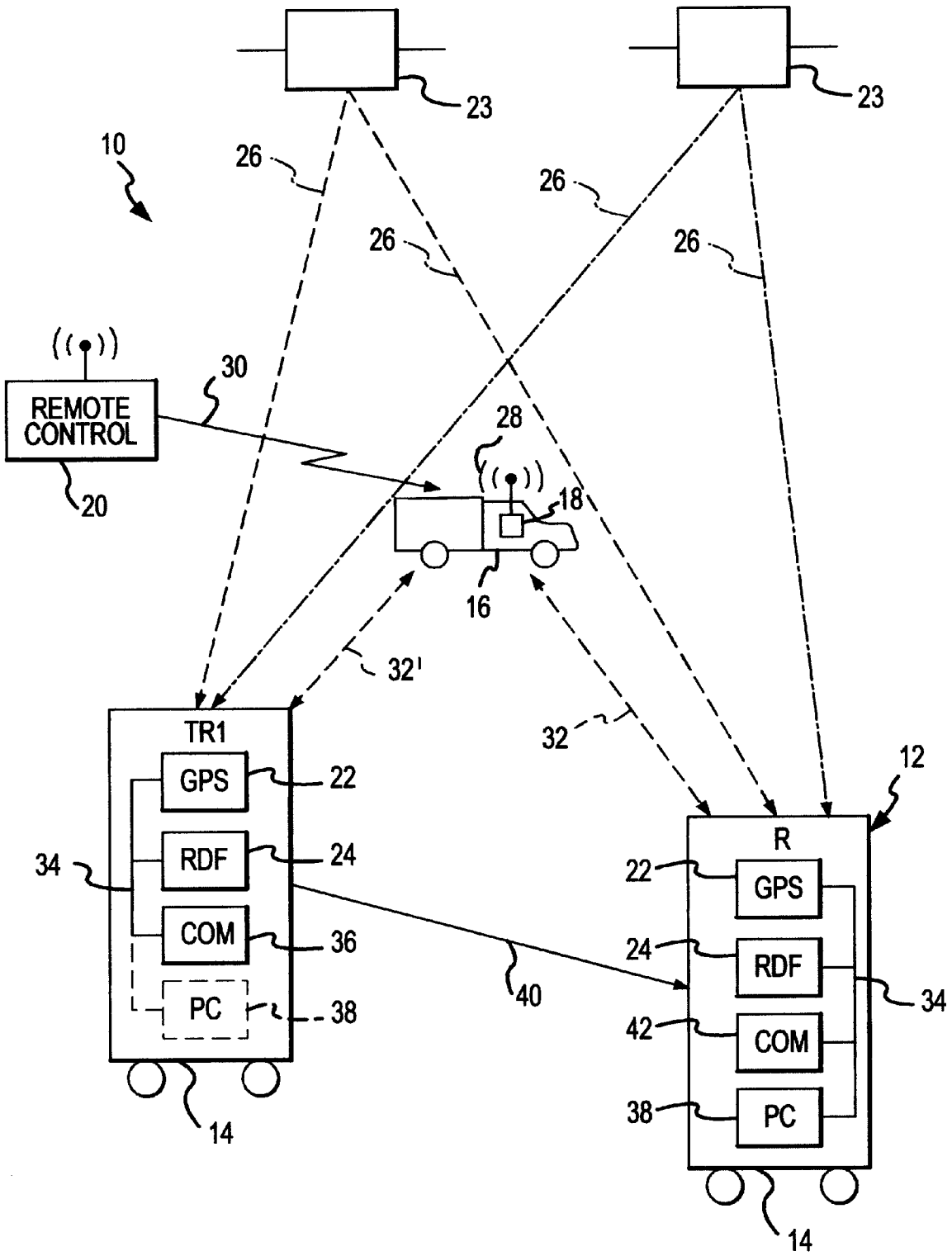
FIG. 1 is a schematic illustration of the invention in which a mobile transmit and receive station and a mobile receive station track the location of a mobile target.

Referring now to FIG. 1, a mobile tracking and positioning system 10 according to a preferred embodiment of the invention is shown in schematic form. The system 10 of FIG. 1 has a mobile receive (R) station 12, a mobile transmit and receive (TR) station 14, and a mobile target 16 to be tracked and located by receive station 12 and transmit and receive station 14. The target 16 has a transmission unit 18 for selectively broadcasting a communication signal 28 (such as a radio signal) in response to the occurrence of a tracking and positioning initiation event. In the case where the target 16 is a vehicle, the initiation event may be the unauthorized movement (e.g., theft) of the vehicle, or it may be the receipt of an activation or initiation signal 30 broadcast from a remote control unit 20 (perhaps a pocket-sized signal transmitter carried by the vehicle's owner) to the target 16 or by a transmit and receive station 14.

The transmit and receive station 14 and the receive station 12 are ideally self contained, portable units that may be installed in a vehicle or carried by a person. They each contain a positioning means 22 for substantially continuously determining the position of the station on (or above) the surface of the earth. A preferred positioning means is a differential global positioning system (GPS) receiver 22 that receives position information from satellites 23 that orbit the earth. Extremely accurate differential GPS receivers with world wide coverage and computer interfaces are now commercially available, such as the Garmin™ Model SRVY II, available from Garmin International, 9875 Widmer Road, Lenexa Kans., and the Trimble TransPak II GPS receiver. An alternative positioning means may be a GLONASS receiver.

Substantially continuous communication 26 between each receiver 22 and at least two satellites 23 permits the receivers 22 to determine and display the real time position of the stations 12 and 14 on the surface of the earth as the stations 12 and 14 move from one place to the other. The position information is obtained even when the stations 12 and 14 are airborne or over expansive bodies of water. Thus, the stations 12 and 14 may participate in the tracking and positioning of the target 16 while they are installed in an aircraft (such as a helicopter), in a boat, or moving on the ground. The GPS receiver 22 places the position information onto a communication data bus 34 in the stations 12, 14.

The stations 12 and 14 further include a direction means 24 for receiving the communication signal 28 broadcast from the target 16 and for responsively determining the direction (vector) 32 between the station and the target. For example, direction means 24 comprising a RDF unit in station 12 determines the direction 32 from station 12 to the target 16 and the RDF unit 24 in station 14 determines the direction 32' between station 14 and the target 16. Where the communication signal 28 is a radio signal, a radio direction finder (RDF) 24 or similar device may be used. Preferably, the RDF contains circuitry for converting the direction information into digital form and for placing the direction signal on the communication bus 34.

The mobile transmit and receive station 14 has a communications system 36 connected to the bus 34 for transmitting information 40 of its current position, the direction 32' to the target 16, and the id codes of the target to the mobile receive station 12. The communication system 36 may use any convenient data link to transmit the position and direction information, such as a modem connected to a cellular or conventional telephone system, a two-way radio communication system, or even a simple walkie-talkie system used by the operator of the station 14. The communications system 36 may be provided with suitable radio transmission circuitry, including a signal generator and an antenna, to enable the communication system 36 to broadcast an initiation signal 30 to the target 16.

As shown in FIG. 1, the transmit and receive station 14 may have an optional personal computer system 38 shown in dashed lines that is also connected to the communications bus 34 and the other components of the station 14. The computer 38 gives the station 14 the capability of determining the location of the target 16 based on the current position and direction information and the position and direction information received from the receive station 12. However, an important function of the transmit and receive station 14 in the simplest embodiment of the invention is to determine its current location and the direction to the target 16, and to transmit that information 40 to the receive station 12. As noted earlier, another function the transmit and receive station 14 may perform is the initiation of the tracking event by transmission of an initiation signal 30 to the target.

In the embodiment of FIG. 1, the mobile receive station 12 comprises the GPS receiver 22 and RDF unit 24 discussed above, and a communications system 42 for receiving the transmitted information 40 of the position of the mobile transmit and receive station 14, the direction 32' of the target 16 to the transmit and receive station 14, and the target's id code. Of course, the type of communications system 42 to be implemented in the receive station 12 is dependent on the type of communication system that is used with the other transmit and receive stations that are used in the system 10, particularly when multiple transmit and receive stations are used, and the communications protocols and modes of transmission should be compatible across the system 10.

The receive station 12 also has a computer 38 such as a battery-operated lap-top computer for determining the location of the target 16 from the position and direction information and target id codes received from the transmit and receive station 14 (together represented by numeral 40) and position and direction information that is obtained by the GPS 22 and RDF 24 units of the receive station 12. The personal computer 38 in the receive station 12 is linked to the communication bus 34 to access the position and direction information from the GPS 22 and RDF 24, respectively, and the incoming information 40 processed through the communication system 42.

Once the position and direction information from both stations 12, 14 has been acquired, the computer 38 in the receive station 12 implements a triangulation algorithm according to well-known techniques in the art to locate the position of the target 16. By virtue of the simultaneous receipt of position and direction information 40 from the transmit and receive station 12 and the receipt of its own position and direction information of the receive unit 12, the computer 38 of the receive station 12 substantially continuously updates the position of the target 16 as the target 16 and the stations 12 and 14 move about or above the surface of the earth. With the location thus determined, the station 12 can take any appropriate action, such as notify the authorities, proceed to the target location, log the position in a journal, etc.

Note that the location of the target 16 will be able to be even more precisely determined if the mobile transmit and receive station 14 stop s moving, even for a few seconds. The mobile receive station 12 receives an upgraded position of the mobile transmit and receive station, and will be able to refine its own position by taking into account the position of the mobile transmit and receive station as a reference point. The resulting calculated position of the target may be more accurate.

Figure 2A:
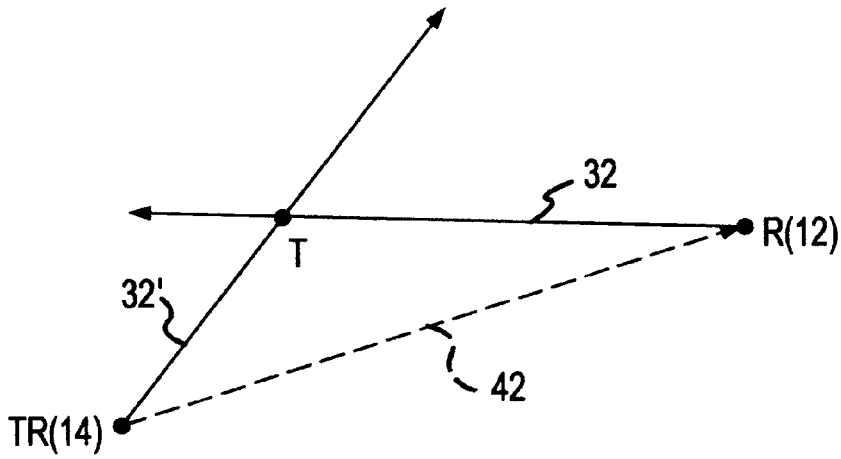
FIG. 2A is a vector diagram illustrating how the location of the target is triangulated by a mobile receive from the known position and direction information.
Figure 2B:
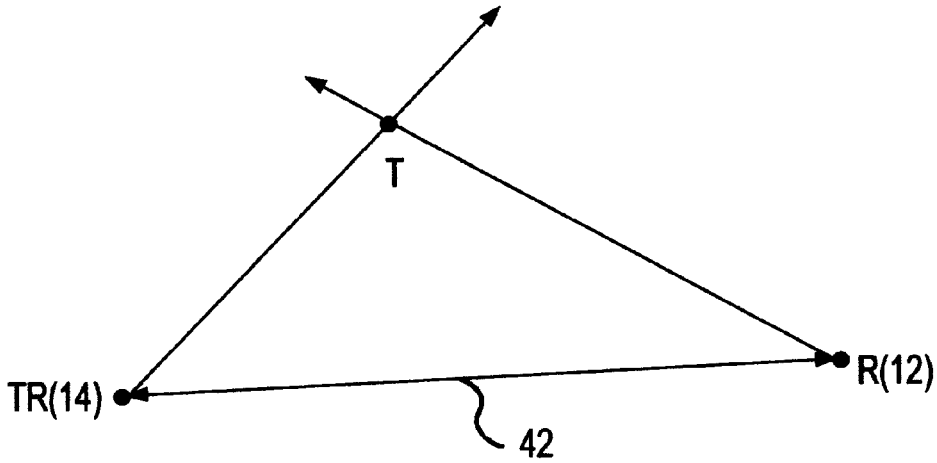
FIG. 2B is a vector diagram illustrating how the location of the target is triangulated by both the mobile receive station and the mobile transmit and receive station.

The triangulation of the target's position is illustrated in FIG. 2A. Let TR represent the known position of the transmit and receive station 14, let R represent the known position of the mobile receive station 12, let 32' represent the known direction of the transmit and receive station 14 to the target T, and let 32 represent the known direction from the receive station 12 to the target T. Station 14 transmits its position and direction information 40 to the receive station 12. The receive station 12 now has all the information to precisely locate the position of T: the intersection of the vectors 32 and 32'. Note that in the illustration of FIG. 2A, the receive station 12 does not transmit its position and direction information to transmit and receive station 14, consequently the transmit and receive station 14 does not have the capability of determining the precise location of the target. As shown in FIG. 2B, this situation is altered if the information flows both ways 42 between the transmit and receive station 14 and the receive station 12. Here, both the mobile transmit and receive station 14 and the receive station 12 share with each other the current position and direction information via their communications systems 36, 42 (FIG. 1). Now, both the transmit and receive station 14 and the receive station 12 can calculate the location of the target T. The result shown in FIG. 2B is achieved in the system of FIG. 1 by providing equal two-way communication and computation tools to both stations 12 and 14. In particular, the communication unit 42 in the mobile receive station 12 should possess the capability of transmitting information of its position and the direction to the target to the mobile transmit and receive station 14 (and not just receiving position and direction information from the station 14), and providing in the mobile transmit and receive station 14 a computer 38 for determining the location of the target from position and direction information of both stations 12, 14. With the receiving station 12 and transmit and receive station 14 thus augmented, both the mobile transmit and receive station 14 and the mobile receive station 12 can determine the location of the target 16.

It should be further noted that the position information of the mobile transmit and receive station 14 (or the mobile receive station 12) could be provided by other means than a GPS receiver. For example, other satellite or positioning systems (such as GLONASS) could be used. Alternatively, a remote station could track the position of the mobile transmit and receive station 14 and broadcast (or even telephone) the location to the mobile transmit and receive station 14. The operator of the transmit and receive station 14 would then input the position information into the computer 38 and the communication system 36 would then transmit the position information and the direction information to the receive station 12. The use of a remote station to externally calculate the position of the stations 12 and 14 will generally require very fast processing of the locations of the stations and quick relay of the positions to the stations. Otherwise, too much time is lost in the derivation of the target location, resulting in inaccurate targeting. This would be particularly true if the target is moving swiftly.

The key function of the positioning means 22 is to provide the transmit and receive station 14 and receive station 12 with real-time position information as the stations 12, 14 move about, and several examples of positioning means have been given. Additional techniques can be used which are equivalent to the GPS receiver. For example, the stations 12, 14 may triangulate their position by receiving radio signals from two different points of known location, determining the direction to the fixed points, and then triangulating the position. The points of known location could be stationary radio transmitters (for example, on the top of a building), or they could be even other transmit and receive stations that send a radio signal and current position information to the stations 12 and 14. In most applications, the use of GPS receivers will simplify matters, but it should be understood that many other equivalent means may be employed. Use of other means such as triangulation from stationary transmitters and remote stations result in a less independent and self-reliant system, hence they are not as preferred. The use of triangulation of position from stationary transmitters also requires fast processing in order for the system to produce accurate target position fixes.

The mobile receive station 12 or the mobile transmit and receive station 14 may further have a display responsive to the computer 38 for displaying the position of the target. The display (not shown) may be integrated with the display unit of the GPS unit 22. Alternatively, the computer 38 may be provided with maps (such as topographical or street maps) on CD ROM and the calculated position of the target 16 may be integrated with the map display on the screen of the computer 38.

Ideally, the mobile transmit and receive stations 14 and the mobile receive stations 12 are self-contained, portable and movable units contained in a suitable housing or enclosure. The stations 12, 14 should be self-powered by a rechargeable battery with capability for plugging into an external power source. The computer 38 should have the processing power of at least an Intel™ 486 microprocessor. The stations 12, 14 are assigned their own personal identification code (for example, stored in the memory of the computer 38) that is compared with the received communication signal 28 from the targets to determine if the stations 12, 14 are designated to participate in the tracking and positioning effort. The stations 12, 14 also are preferably assigned a general identification code so that if the general identification code is broadcast by the target 16, all stations in the area participate in the tracking and positioning effort. Additionally, to provide maximum flexibility to the system, it may be desirable to have all the stations 12, 14 have two-way communications systems 36 capable of transmitting and receiving position and direction information, and computers 38 with digital mapping systems, so that every station 12, 14 can have the ability to determine the location of the target. The communication systems 36 installed in the stations 12, 14 should ideally have the capability to receive several incoming data transmissions at the same time, so that the stations can simultaneously process the directional signal from the target and the position and direction data from at least one other station to compute the location of the target.

As shown in FIG. 1, the system 10 may further comprises a remote control unit 20 that, on demand, initiates the activation of the target 16 by broadcast of the initiation signal 30. The target 16 has a transmission unit 18 for receiving the initiation signal 30 from the remote control unit 20. The receipt of the initiation signal 30 causes the target 16 to commence broadcast of the communication signal 28. Prior to the receipt of the initiation signal 30, the transmission unit 18 of the target 16 is in a power-down or dormant mode of operation to conserve power. The remote control unit 20 is illustrated in FIG. 1 as a separate stand alone unit, but the initiation signal 30 could just as well be sent by a transmit and receive station 14 or a receive station 12. The remote control 20 of FIG. 1 is preferably a miniature, portable remote control unit which performs the function of initiating the whole tracking process by sending out an initiation signal 30. The remote control unit 20 should have the capability of sending two types of initiation signals: a general identification signal thus allowing all stations 12, 14 to receive the communications signal 28, and an initiation signal initiating the process whereby only certain stations 12, 14 are designated to participate in the tracking effort. To accomplish this, the remote control 20 may have two switches (one corresponding to the general identification, the other corresponding to a particular set of stations) and possibly an interactive routine whereby the operator of the remote control can change the designation of the tracking stations 12, 14.

Figure 3:
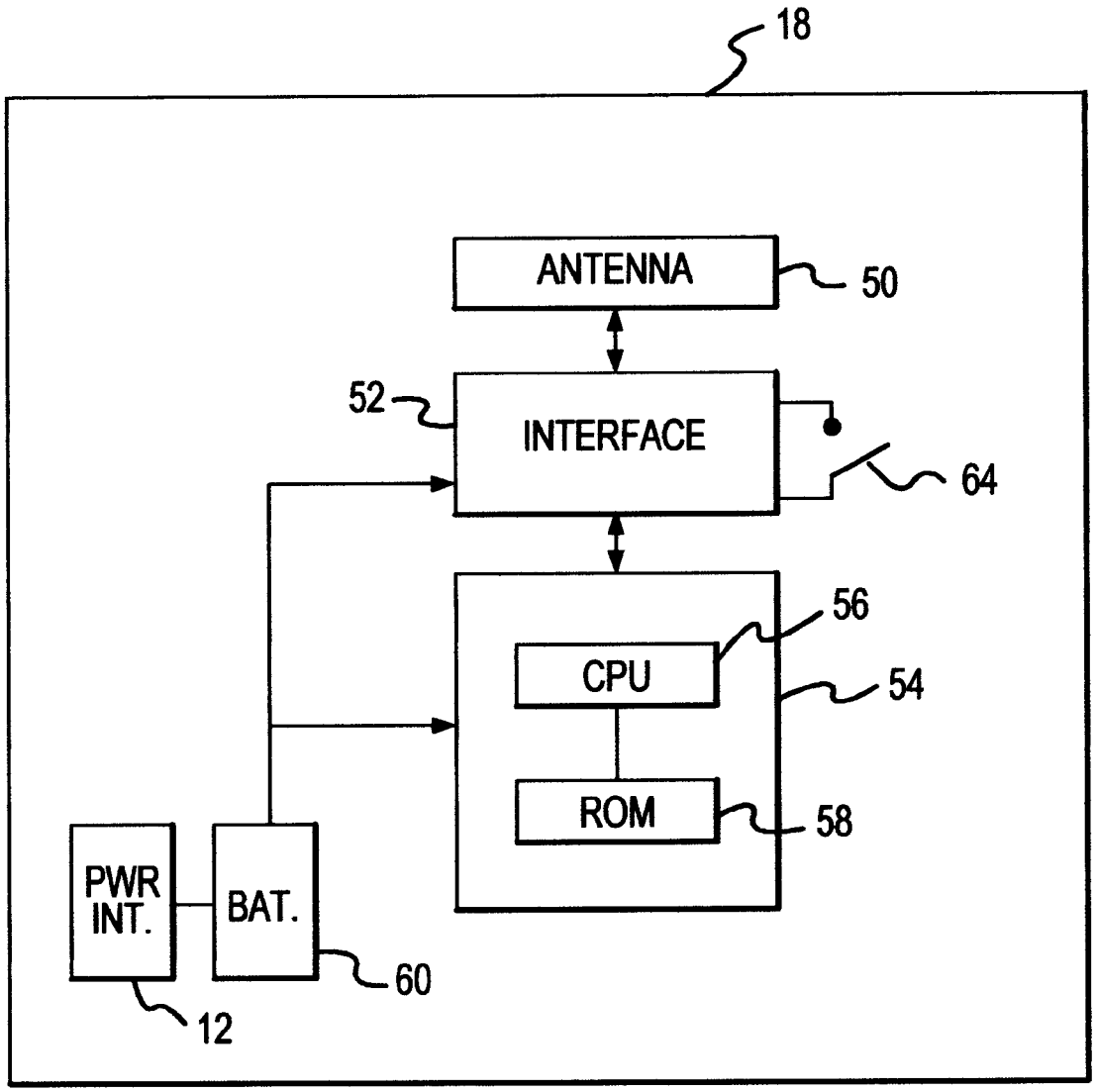
FIG. 3 is a block diagram of the transmission unit that is located on the target.

Referring to FIG. 3, the transmission unit 18 of FIG. 1 is shown in greater detail in block diagram form. Preferably, the unit 18 is a highly miniaturized, self-contained unit that is easily hidden in a vehicle or carried on a person. The unit 18 has an antenna 50 for receipt of the initiation signals 30 and for broadcast of the communication signals 28 to the transmit and receive stations 14 and the receive stations 12. The antenna 50 is in electrical communication with a communications interface 52 that performs signal filtering and conditioning, amplification and analog to digital conversion of the incoming initiation signal. The interface 52 also performs digital to analog conversion and signal generation functions for broadcasting the communication signal 28 via antenna 50. If digital communication links are used, obviously no A/D conversion is required.

The transmission unit 18 further includes a computer system 54 having a central processing unit 56 and a memory 58. A battery unit 60 supplies power to the interface 52 and computer 54 components. The battery 60 may have a power interface 62 so that the entire unit 18 may receive power from a host system, such as the battery system that the unit 18 is installed in. The transmission unit 18 is assigned a unique identification code that is stored in the memory 58 of the computer unit 54. The unit 18 may also be assigned a general identification code. The interface 52, acting under the supervision of the computer 54, preferably broadcasts at an intermittent signal rate and frequency depending on the receipt of coded instructions from the remote control 20 (or alternatively from the stations 12 or 14). The changing of frequencies or signal rates involves transmission of coded signals from the stations 12, 14 that have been previously assigned to particular transmission protocols. The transmission unit 18 receives the coded signals, processes them in the interface 52 (e.g., filters, amplifies and digitizes, if necessary, the signals), and passes them to the computer 54. The computer compares the coded signals after the processing steps have been performed with a look-up table or other similar software structure or database resident in computer memory 58 and configures the signal transmission function of the interface unit 52 to broadcast according to the new regime.

The transmission unit 18 may have a switch 64 that, when activated, causes the unit 18 to change state from a dormant or power-down mode to an active mode, in which the unit 18 broadcasts the communication signal 28, enabling tracking of the target 16. The switch 64 may be installed in the host vehicle in a manner similar to the way a car alarm is installed, such that when the vehicle is moved without the owner's authorization, the transmission unit 18 begins broadcasting. One example would be activation of the switch 64 when the car's ignition system is energized. Another example is the opening of the driver or passenger doors. In a surveillance application in which the target wishes to be tracked, the target person could simply close the switch 64 and cause initiation of the broadcast of the communication signal 28. The switch 64 that is associated with the transmission unit 18 may be incorporated into the body of the transmission unit 18. Alternatively, the switch 64 may be installed in the manner of an ON-OFF switch or button physically remote from the transmission unit 18, but which is operably connected in any conventional fashion to the unit 18 to be manually manipulated, such as by the driver of the vehicle when the target is a vehicle. Thus, the tracking process can be initiated by (1) either human intervention at the target or unauthorized movement of the target (by closing switch 64); (2) by receipt of an initiation signal from a remote control 20; or (3) by receipt of an initiation signal from a mobile transmit and receive station 14. Preferably, the transmission unit 18 has the capability of turning off, i.e., ceasing broadcast of the signal 28, either directly, as by opening switch 64 or by operation of a separate on-off switch (not shown), or indirectly, such as by receipt of a termination signal from a mobile transmit and receive station 14 that causes a termination routine to be executed by the computer 54.

In one aspect of the invention, the initiation signal 30 broadcast by the remote control 20 preferably comprises a first coded activation signal, the code being associated with a particular target to be tracked, and a second coded identification signal that is associated with one or more mobile receive stations 12 or mobile transmit and receive stations 14 that are designated to participate in the tracking and positioning of the target 16. Referring to FIG. 3, the transmission unit 16 receives the first and second coded signals by the antenna 50. The signals are processed by the interface unit 52, digitized if necessary, and passed to the computer 54. The central processing unit 56 of the computer 54 then compares, via a software structure such as a look-up table, the digitized first and second coded signals with programmed identification in formation stored in the memory 58.

If the first coded activation signal matches the identification information stored in the memory 58, the unit 18 belongs to a target that is to participate in a tracking and positioning event. Otherwise, the unit 18 remains in a power-down mode. In the case of a match, the unit 18 begins broadcasting a communication signal 28 that comprises a first identification signal associated with the target 18 (for example, coded information identifying the identity of the target, and possibly other information such as the date when the target received a transmission unit). The second coded identification signal received by the transmission unit 18 from the remote control 20 is likewise filtered and conditioned in the interface unit 52 and passed to the computer 54, where it is compared in the central processing unit 56 with preprogrammed identification information stored in the memory 54 to determine which mobile transmit and receive stations 14 and mobile receive stations 12 are to participate in the tracking and positioning effort. After the comparisons are performed (via software), the transmission unit 18 broadcasts a second identification signal to the mobile transmit and receive stations 14 and mobile receive stations 12. The second identification signals are in turn processed by the communication systems of the mobile receive stations 12 and mobile transmit and receive stations 14, and only those stations 12 and 14 in which their own internal identification codes match the second identification signals become activated and commence participation in the tracking and positioning of the target 16. It will be understood that other types of communication signals could be broadcast by the transmission unit 18, including digitized or analog voice signals. Obviously, no repetition rate would be present in a voice signal, but a conventional radio signal may be broadcast at a particular repetition rate.

Figure 4:
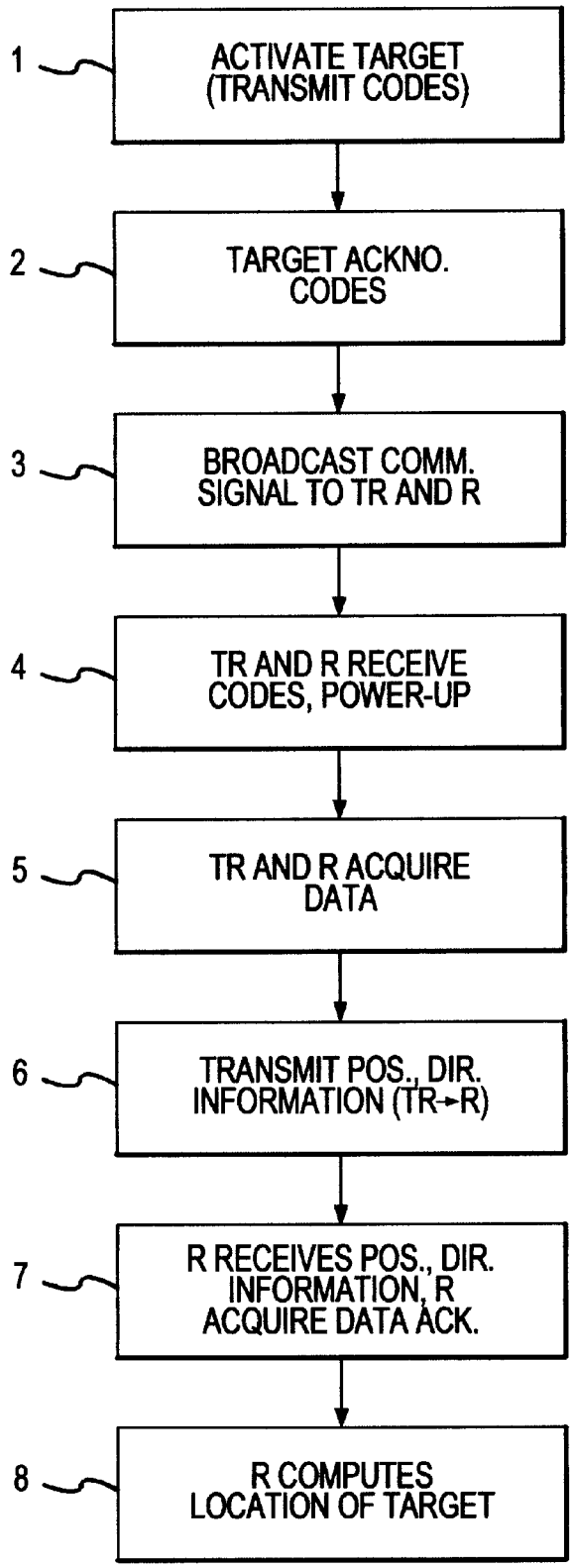
FIG. 4 is a flow chart illustrating the steps involved in the tracking and positioning of a target according to a preferred embodiment of the invention.

Referring now to FIG. 4, the flow chart illustrates the sequence of events in one example of the invention. At step one, the target 16 is activated, such as by the remote control 20 or by a transmit and receive station 14. In the latter example, the transmit and receive station 14 sends three codes to the target: (1) the initiating transmit and receive station's 14 personal id code, (2) the id codes of the other transmit and receive stations 14 and receive stations 12 that are chosen to participate in the tracking and locating effort, and (3) the id code of the chosen target.

At step 2, the target 16 acknowledges the codes by comparing the received codes with a software structure resident in the computer 54.

At step 3, if the comparison at step 2 results in a match, the target 16 commences broadcast of a radiofrequency communication signal 28 to the initiating station 14, which includes the id codes of the chosen transmit and receive stations 14 that are designated for participation (other than the initiating station's code if it is going to participate). The signal 28 is also broadcast to all the transmit and receive stations 14 and receive stations 12 that are in the area.

At step 4, all the transmit and receive stations 14 and receive stations 12 receive the communication signal (including id codes) from the target 16. The transmit and receive stations 14 and the receive stations 12 that have personal id codes that match the id codes transmitted in the communication signal are placed in a powered-up mode from a previous inactive or power-down state.

At step 5, the transmit and receive stations 14 initiate acquisition of data from the target 16 (including direction information) and obtain current position information from the GPS receivers 22.

At step 6, the transmit and receive stations 14 broadcast current position information and direction information from the target to the designated receive stations 12 (or to other transmit and receive stations 14 that also function to receive position and direction information in addition to transmitting position and direction information).

At step 7, the receive stations 12 (or other transmit and receive stations 14 that also function to receive position and direction information in addition to transmitting position and direction information) acquire the position and direction information from the transmit and receive stations 14. The receive stations 12 also obtain direction information from the target 16 via their own RDF 24 and current position information from their own GPS receiver 22.

At step 8, the receive station 12 compiles and processes its own position and direction information and the received position and direction information and computes the target position. The process may continue with the display of the target position on a digital mapping system.

Figure 5:
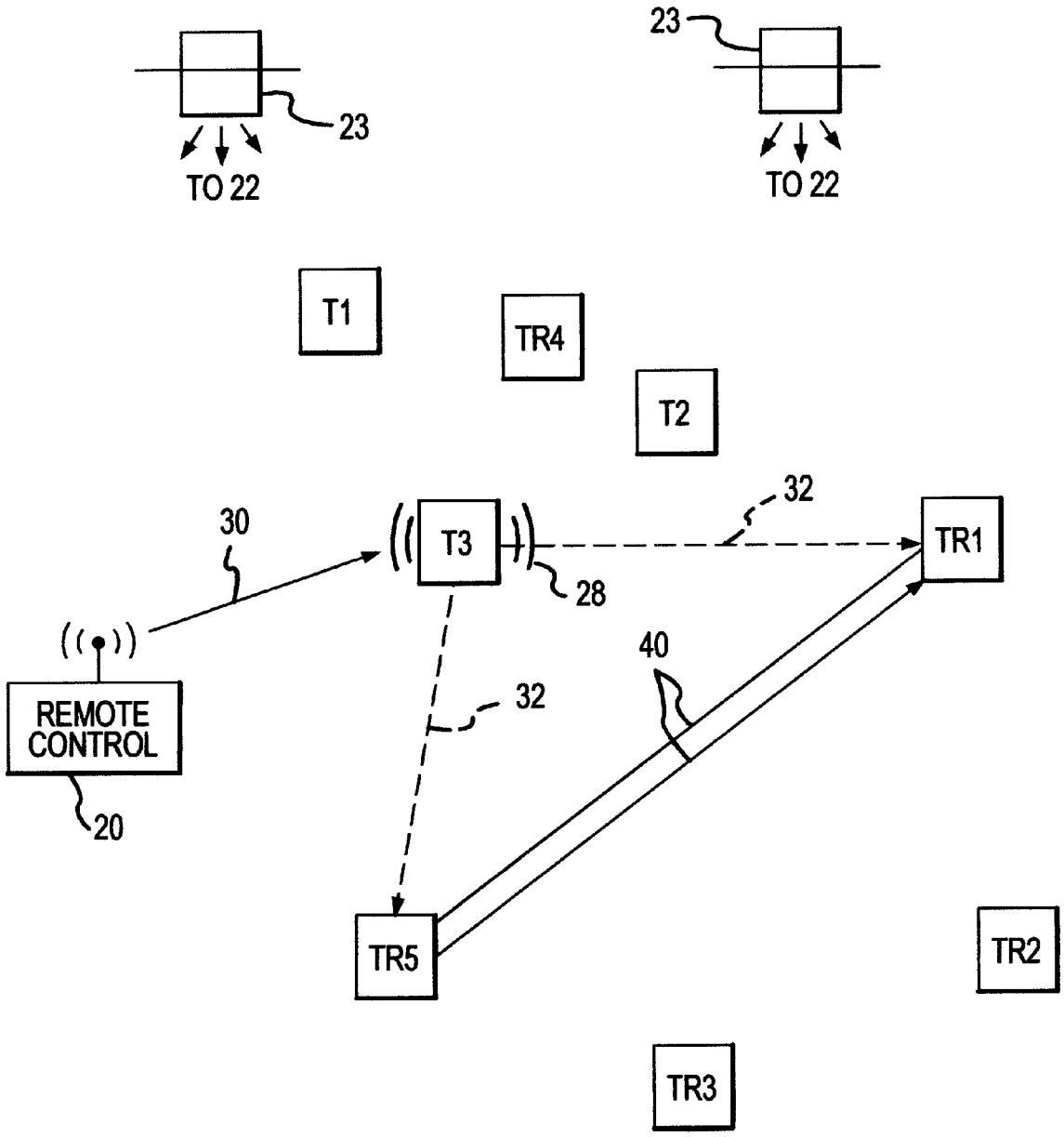
FIG. 5 is a schematic illustration of an implementation of the invention in which only one target of multiple available targets is activated and tracked by only certain designated mobile transmit and receive stations, the remaining targets and mobile transmit and receive stations remaining in a power-down mode.

FIG. 5 is a schematic illustration of an implementation of the invention in which only one target, for example T3, of multiple available targets T1–T4, is activated by the remote control 20. The target T3 is tracked by only certain designated mobile transmit and receive stations, i.e., TR1 and TR5. The other mobile transmit and receive stations TR2, TR3 and TR4 remain in a power-down mode, awaiting start-up from the remote control 20. The remote control 20 designates the target for tracking and the particular transmit and receive stations for tracking and positioning depending on which signals it sends to the targets, i.e., the particular first coded activation signal associated with the target and the second coded identification signals associated with general identification or predetermined set of tracking stations. As shown in FIG. 5, the two transmit and receive stations TR1 and TR5 exchange position and direction information 40 to enable either station to compute the location of the target T3. The purpose of the remote control 20 is simply to turn the target ON, and either cause the target to either activate all the available tracking stations, as by transmitting a general identification signal, or else activate a predetermined set of stations.

In the case where the operator of the system 10 wishes to have all available mobile transmit and receive stations and receive stations participate in the search, the second coded identification signal 30 from the remote control to the target 16 comprises a general identification signal that is associated with all of the mobile transmit and receive stations 14 and mobile receive stations 12 in the area. The transmission unit 18 then rebroadcasts a general identification signal to all the stations 12 and 14 and they all become active.

Since each target has its own unique identification code, it is possible that several different targets can be tracked simultaneous by the same mobile transmit and receive stations 14 and mobile receive stations 12. While the example of FIG. 5 refers to tracking of a single target, it will be apparent that multiple targets (e.g., T1 and T3) may be in an active state at the same time; and both targets may designate as tracking stations TR1 and TR5 (or perhaps some other combination of transmit and receive stations). In this event of simultaneous tracking of multiple targets, the receipt and processing of the signals 28 from the targets are the same as described in detail above. The transmission of id codes of the target and position and direction information 40 between tracking stations must be accompanied by a code or other type of signal that associates the direction information 32 with a particular target. This insures that the location of the target is tracked correctly and that the target direction information is not mixed up with the wrong target.

Figure 6:
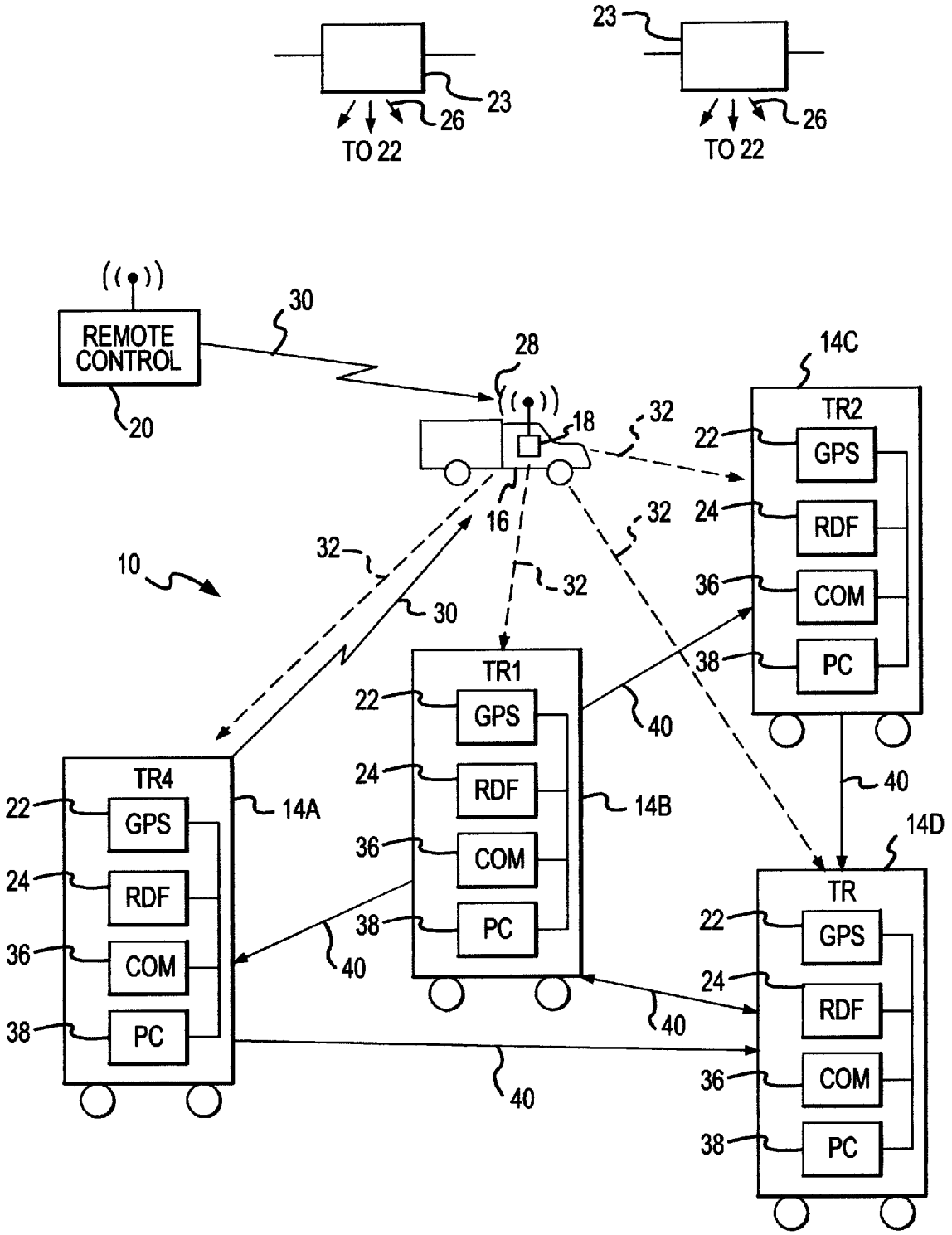
FIG. 6 is a schematic illustration of an alternative embodiment of the invention in which a plurality of mobile transmit and receive stations, each with their own computers, track the location of a mobile target.

Referring now to FIG. 6, there is illustrated, in schematic form, an embodiment of the invention in which a plurality of mobile transmit and receive stations 14A, 14B, 14C and 14D participate in the tracking and positioning of a mobile target 16. The target 16 includes the transmission unit 18 for on demand broadcasting a communication signal 28 in response to a tracking and positioning initiation event, such as the receipt of an activation signal 30 from the remote control 20 or from a transmit and receive station 14. Again, the initiation event could alternatively be the unauthorized movement of the vehicle 16, or the activation of a switch associated with the transmission unit 18 as described in detail above.

Each of the mobile transmit and receive stations 14 comprises a positioning means 22 for substantially continuously determining the position of the mobile transmit and receive stations 14, such as a GPS receiver. The stations 14 further have a direction means 24 such as radio direction finders RDF for receiving the communication signal 28 broadcast from the target 16 and for responsively determining the direction from the mobile transmit and receive stations 14 to the target 16. The stations 14 further have two-way communication systems 36 for transmitting information as to the target's id code, and the position of stations 14 and the direction 32 of the target 16 to the stations 14, from one station 14 to the other transmit and receive stations 14. This transmission of position and direction information and the target id code from one station to the other is shown schematically by the arrows 40. The stations 14 further have computers 38 for implementing a triangulation algorithm to locate the target 14 from the station's 14 own position and direction information and the received position and direction information from one or more other stations 14.

By virtue of the substantially simultaneous sharing of position and direction information, the computers 38 thus can substantially continuously update the position of the target 16 as the target 16 and the mobile transmitting and receiving stations 14A–D move about or above the surface of the earth.

It will be noted from FIG. 6 that stations 14A, 14B and 14C each calculate the position of the target 16 based on their own respective position and direction information and the position and direction information received from one other station. However, station 14D can calculate the position of the target 16 from its own position and direction information and the position and direction information that it receives from three other stations, stations 14A, 14B and 14C. Thus, station 14D should be able to calculate the position of the target 16 with even greater accuracy than the other stations 14A–C. If the operator of the system 10 wishes to change the communication pattern between the stations 14A–14D, the operator contacts the operators of the stations 14A–D by any convenient means (such as by cellular telephone) and passes on new instructions. Of course, the process could be automated, such as by broadcasting from the remote control 20 (or from some other point) a set of coded identification signals to each of the stations 14 that contain instructions as to which stations 14 are to transmit position and direction information to which other stations 14.

Those of ordinary skill in the art will appreciate that particular applications of the invention may necessitate variance from the particulars of the foregoing description of preferred and alternative embodiments of the invention, and that such variations are within the invention's true spirit and scope. This true spirit and scope of the invention is defined by the appended claims, to be interpreted in light of the foregoing specification.

I claim:

1. A method of locating a target by triangulation in a region lacking a fixed positioning reference for participating in the triangulation wherein the target includes a transmission unit adapted to broadcast a radio signal in response to an initiation event, said method comprising the steps of:

providing first and second mobile tracking stations that transit the region of the target;

initiating a broadcast of a radio signal from said target in response to the occurrence of said initiation event;

determining the direction of origin of said radio signal relative to said first station;

substantially simultaneously with the determination of the direction of origin of said signal relative to said first station;

a) determining the position of said first station at or above the surface of the earth;

b) transmitting said position and said direction of origin from said first station to said second station;

c) determining the position of said second station;

d) determining the direction of origin of said signal at said second station; and subsequently triangulating said position of said target at said second station from said positions of said first and second stations and said directions of origin of said radio signal from said target to said first and second stations.

2. The method of claim 1, further comprising the step of: displaying said position of said target at said second station.

3. The method of claim 1, further comprising the step of: transmitting said position of said target from said second station to said first station.

4. The method of claim 3, further comprising the step of displaying the location of said target at said first station.

5. The method of claim 1, wherein a third mobile station participates in the tracking and positioning of said target, and wherein said third station determines the direction of origin of said radio signal and the instantaneous position of said third mobile tracking station at or above the surface of the earth and transmits said direction and said instantaneous position to said second station substantially simultaneous with the transmission of direction and position information from said first station to said second station, thereby increasing the accuracy of the tracking and positioning of said target by said second station.

6. The method of claim 1, wherein said target comprises a vehicle and said initiation event comprises unauthorized movement of said vehicle to activate said signal broadcast.

7. The method of claim 1, wherein said initiation event comprises receipt at said target of an initiation signal broadcast by one of said first or second mobile stations.

8. The method of claim 1, wherein said initiation event comprises receipt at said target of an initiation signal broadcast by a remote control unit.

9. The method of claim 1, wherein said target includes a transmission unit for broadcasting said radio signal, said transmission unit responsive to a switch causing initiation of broadcast of said radio signal, wherein said initiation event comprises operation of said switch to cause initiation of broadcast of said radio signal.

10. The method of claim 1, wherein the method further comprises the step of terminating broadcast of said radio signal from said target, said step of terminating comprising the step of broadcasting a termination signal to said target, said target responsively terminating broadcast of said radio signal and entering a power-down mode.

11. A self-contained, portable, mobile tracking and positioning unit for locating a target by triangulation wherein the target broadcasts a radio signal in a region on the surface of the earth which lacks a fixed positioning reference for participating in the triangulation, said positioning unit comprising, in combination:

a positioning determination device for determining the position of said mobile tracking and positioning unit;

a direction finder for determining the direction of origin of said broadcast radio signal;

a two-way communication system for transmitting position information determined from said positioning determination device and direction information determined by said direction finder and for receiving position information and direction information from a remote station; and a computer for processing said determined position and direction information and said received position information and direction information to locate said target.

12. The mobile tracking and positioning unit of claim 11, wherein said positioning determination device comprises a global positioning system receiver.

13. The mobile tracking and positioning unit of claim 11, wherein said positioning determination device comprises a GLONASS receiver.

14. A method utilizing triangulation for simultaneously tracking a plurality of mobile targets in a region devoid of a fixed positioning reference that participates in the triangulation, said method comprising:

providing a plurality of mobile tracking stations including at least first and second mobile stations adapted to transit said region wherein at least two of said tracking stations cooperatively provide mobile position references for locating a plurality of targets by triangulation, initiating broadcast of a radio signal from said targets in response to the occurrence of an initiation event at said targets;

determining the direction of origin of said radio signals from each of said plurality of targets relative to said first mobile station;

substantially simultaneously with the determination of the direction origin of said radio signals relative to said first mobile station:

a) determining the instantaneous position of said first mobile station at or above the surface of the earth;

b) transmitting said instantaneous position and said direction of origin from said first mobile station to said second mobile station;

c) determining the instantaneous position of said second mobile station;

d) determining the direction of origin of said radio signals broadcast by said targets at said second mobile station; and subsequently triangulating said positions of said targets at said second mobile station from said positions of said first and second mobile stations and said respective directions of origin of said radio signals from said targets to said first and second mobile stations.

15. A tracking system for locating or tracking a mobile target by triangulation in a region that lacks a fixed participating navigation reference in the vicinity of said target, said system comprising:

first and second mobile tracking stations adapted for transgressing said region in the vicinity of said target and for cooperatively providing instantaneous position references for locating a target by triangulation;

a transmitter disposed at said target for broadcasting a communication signal in response to an initiation event;

said first mobile tracking station further including a position determination unit utilizing a navigation reference external of said region for determining a first instantaneous position indicative of the position of said first mobile tracking station while transiting the vicinity of the target, a bearing determination unit including a receiver for receiving the communication signal from said target and for determining a first target bearing indicative of the relative direction to said target from said first mobile tracking station on the basis of said communication signal, and a transmitter unit for transmitting said first target bearing information and said first instantaneous position of the first tracking station;

said second mobile tracking station further including a receiver for receiving said first target bearing and said first instantaneous position transmitted by said first mobile tracking station, a position determination unit utilizing a navigation reference external of said region for determining a second instantaneous position indicative of the position of said second mobile tracking station while transiting the vicinity of the target, a second bearing determination unit adapted for determining a second target bearing indicative of the relative direction to said target from said second tracking station on the basis of said communication signal transmitted from said target transmitter; and a processor for analyzing said first and second instantaneous positions of said first and second mobile tracking stations and said first and second target bearings thereby to ascertain by triangulation the exact position of said target.

16. The system of claim 15, wherein at least one of said first and second mobile tracking stations further comprise display means for displaying the position of said target.

17. The system of claim 15, wherein said system further comprises a remote control that broadcasts an initiation signal, wherein said target further comprises a means for receiving said initiation signal from said remote control and wherein said tracking and positioning initiation event comprises the transmission of said initiation signal from said remote control to said target causing said target to commence broadcast of said communication signal.

18. The system of claim 15, wherein said target comprises a vehicle, and wherein said tracking and positioning initiation event comprises unauthorized movement of said vehicle to activate said signal broadcast.

19. The system of claim 15, wherein said positioning determination unit of said first mobile tracking station comprises a global positioning system receiver.

20. The system of claim 15, wherein said positioning determination unit of said second mobile tracking station comprises a global positioning system receiver.

21. The system of claim 15, wherein said system further comprises a remote station tracking the position of said first mobile tracking station and a communication system for broadcasting said position to said first mobile tracking station, wherein the position of said first mobile tracking station is determined by said remote station, and wherein said position determination unit of said first mobile tracking station comprises means for receiving said broadcast position information.

22. The system of claim 15, wherein said system further comprises a remote station tracking the position of said second mobile tracking station and a communication system for broadcasting said position to said second mobile tracking station, wherein the position of said second mobile tracking station is determined by said remote station, and wherein said position determination unit of said second mobile tracking station comprises means for receiving said broadcast position information.

23. The system of claim 15, wherein at least one of said first and second mobile tracking station is airborne.

24. The system of claim 15, wherein said first mobile tracking station further comprises means for broadcasting an initiation signal to said target, wherein said target further comprises means for receiving said initiation signal from said first mobile tracking station, and wherein said tracking and positioning initiation event comprises the transmission of said initiation signal from said first mobile tracking station to said target causing said target to commence broadcast of said communication signal.

25. The system of claim 15, wherein said initiation event comprises receipt of an initiation signal broadcast to said target, and wherein said initiation signal comprises:

a first coded activation signal associated with said target to be tracked; and a second coded identification signal containing codes associated with one or more first and second mobile tracking stations designated to participate in the tracking and positioning of said target;

and wherein said communication signal broadcast by said target comprises a first signal comprising a first identification signal associated with said target and a second identification signal associated with said first and second mobile tracking stations designated to participate in the tracking and positioning of said target.

26. The system of claim 25, wherein said second coded identification signal comprises a general identification signal associated with each of said plurality of first and second mobile tracking stations.

27. A tracking system as recited in claim 15 wherein said first mobile tracking station also ascertains the position of the target, said system further comprising:

a transmitter unit associated with said second mobile tracking station for transmitting said second target bearing and the instantaneous position of the second tracking station to said first mobile tracking station; and a second receiver associated with said first mobile tracking station for receiving said second target bearing and said instantaneous position transmitted from said second mobile tracking station; and a second processor responsive to information from the second receiver for analyzing the instantaneous positions first and second mobile tracking stations and first and second target bearings thereby to ascertain by triangulation the exact position of said target.

28. A tracking system as recited in claim 15 wherein said region lies on the surface of the earth.

29. A tracking system as recited in claim 15 further including a switch located at said target for activating said transmitter thereby to produce said initiation event.

30. A tracking system as recited in claim 15 wherein at least one of said first mobile tracking station, said second mobile tracking station and said processor broadcasts a signal for effecting said initiation event.

31. A tracking system as recited in claim 15 wherein said processor is located at said second mobile tracking station.

32. A tracking system as recited in claim 15 wherein said processor is located at a third station.

33. A method as recited in claim 14, wherein said target and said mobile tracking stations are adapted for activation upon receipt of an activation code, said method further comprising:

in said initiating step, broadcasting said radio signal at said target in response to receipt of a first coded activation signal associated with said target to be tracked; and in said determining steps, performing said determining steps in at least two of said mobile tracking stations in response to receipt of a second coded identification signal containing codes associated with one or more first and second mobile tracking stations designated to participate in the tracking and positioning of said target.

34. A tracking system for locating or tracking a mobile target by triangulation in a region that lacks a fixed navigation reference in the vicinity of said target for participating in the triangulation, said system comprising:

a) first and second mobile tracking stations adapted for transgressing said region in the vicinity of said target;

b) a transmitter disposed at said target for broadcasting a communication signal in response to an initiation event;

c) said first mobile tracking stations further including a position determination unit utilizing a navigation reference external of said region for determining the instantaneous position of said first mobile tracking station while transiting the vicinity of the target in said region, a bearing determination unit including a receiver for receiving the communication signal from said target and for determining target bearing information indicative of the relative direction to said target from said first mobile tracking station in response to receipt of said communication signal from said target transmitter, and a transmitter unit for transmitting target bearing information and said instantaneous position of the first tracking station;

d) said second mobile tracking station further comprising a position determination unit utilizing a navigation reference external of said region for determining the instantaneous position of said second mobile tracking station while transiting the vicinity of the target in the region, a bearing determination unit for determining target bearing information indicative of the relative direction of said target from said second tracking station in response to receipt of said communication signal from said target transmitter, and a transmitter unit for transmitting said target bearing information and the instantaneous position of said second tracking station; and e) a processor for analyzing the instantaneous positions of said first and second mobile tracking stations and the bearing information transmitted from said first and second mobile tracking stations thereby to ascertain by triangulation the exact position of said target.

35. A tracking system as recited in claim 34 further including a display device in communication with said processor and being connected with at least one of said first and second mobile tracking stations for indicating the position of said target.

36. A tracking system as recited in claim 34 further including a display device being located at a remote station that communicates with said processor for indicating the position of said target.

* * * * *